US007472674B2

(12) United States Patent
Robelet

(10) Patent No.: US 7,472,674 B2
(45) Date of Patent: Jan. 6, 2009

(54) METHOD OF MANUFACTURE OF A PISTON FOR AN INTERNAL COMBUSTION ENGINE, AND PISTON THUS OBTAINED

(75) Inventor: Marc Robelet, Florange (FR)

(73) Assignee: Ascometal, Courbevoie (FR)

( * ) Notice: Subject to any disclaimer, the term of this patent is extended or adjusted under 35 U.S.C. 154(b) by 0 days.

(21) Appl. No.: 10/726,651

(22) Filed: Dec. 4, 2003

(65) Prior Publication Data

US 2004/0129243 A1 Jul. 8, 2004

(30) Foreign Application Priority Data

Dec. 5, 2002 (FR) ..... 02 15376

(51) Int. Cl.
*B22D 17/00* (2006.01)

(52) U.S. Cl. ..... 123/193.6; 164/900

(58) Field of Classification Search ..... 123/193.6; 164/900; 148/500; 72/364, 377, 359; 29/888.04
See application file for complete search history.

(56) References Cited

U.S. PATENT DOCUMENTS 2,377,463 A * 6/1945 Townhill ..... 92/239
2,865,348 A * 12/1958 Kramer et al. ..... 123/41.35
3,703,126 A * 11/1972 Haug ..... 92/186
3,753,694 A 8/1973 Badia et al.
3,865,581 A 2/1975 Sekino et al.
3,943,908 A * 3/1976 Kubis et al. ..... 123/193.6
4,457,355 A * 7/1984 Winter et al. ..... 164/468
4,569,218 A 2/1986 Baker et al.
4,638,535 A * 1/1987 Pryor et al. ..... 86/19.5
4,694,881 A 9/1987 Busk
4,804,034 A * 2/1989 Leatham et al. ..... 164/46
5,136,992 A 8/1992 Bregler et al.
5,331,932 A * 7/1994 Watanabe et al. ..... 123/193.6
5,778,533 A * 7/1998 Kemnitz ..... 29/888.049
5,934,174 A * 8/1999 Abraham et al. ..... 92/222
6,112,715 A * 9/2000 Nigro et al. ..... 123/279
6,286,414 B1 * 9/2001 Kruse ..... 92/186
6,311,759 B1 * 11/2001 Tausig et al. ..... 164/113
6,372,063 B1 4/2002 Grillon
6,381,842 B2 * 5/2002 Kato et al. ..... 29/888.044
6,547,896 B2 * 4/2003 Uggowitzer et al. ..... 148/549
6,994,758 B2 * 2/2006 Robelet ..... 148/544
7,005,017 B2 * 2/2006 Robelet ..... 148/544

FOREIGN PATENT DOCUMENTS

DE 10110769 C1 10/2002
EP 0 080 786 B1 5/1987
JP 2000-186616 7/2000

OTHER PUBLICATIONS

SSR Integral-GTI Wheels by Jeff Lucius, 1971.*
"Near net shape forging of metal matrix composites with non-circle core" by Yokohama, J. Oct. 27, 2002.*

* cited by examiner

*Primary Examiner*—M. McMahon
(74) *Attorney, Agent, or Firm*—Wenderoth, Lind & Ponack, L.L.P.

(57) ABSTRACT

A piston for an internal combustion engine is formed from a metal part cast in one piece. Heating of a billet is carried out so as to bring it to an intermediate temperature between its solidus temperature and its liquidus temperature, and shaping thereof by thixoforging is carried out.

2 Claims, 1 Drawing Sheet

METHOD OF MANUFACTURE OF A PISTON FOR AN INTERNAL COMBUSTION ENGINE, AND PISTON THUS OBTAINED

BACKGROUND TO THE INVENTION

The invention relates to the field of pistons for internal combustion engines, particularly for motor vehicles, heavy goods vehicles, agricultural machines, public works machines, and ships.

In recent years high-performance internal combustion engines have been developed which in particular have higher levels of specific power in order to meet new and future anti-pollution standards on $CO_2$ emissions. This is particularly true in the case of diesel engines. This increase in the specific power levels involves a very substantial increase in the thermal and mechanical stresses to which the engine parts, and particularly the pistons, are subjected. Consequently the design of pistons is becoming increasingly complex.

Pistons are usually produced in one piece from moulded or forged aluminium alloy. However, the increased stress conditions which have just been mentioned render the conventional pistons unsuitable. Consequently various solutions have been conceived to render the aluminium pistons compatible with the high-performance engines: insertion of alumina fibers in the alloy to reinforce it, addition of steel inserts to reduce the expansion, deposition of graphite on the skirt to reduce friction, or machining of cooling channels to make the air or oil circulate there in such a way as to keep the piston at acceptable operating temperatures. However, all these solutions are expensive.

One conceivable solution might be the replacement of the aluminium alloy by a steel which, with comparable geometry, would have a better resistance to the mechanical and thermal stresses and to fatigue and a better temperature resistance. In fact, in the past steel has been used to manufacture pistons, but the use of steel for the manufacture of pistons for high-performance engines is not in fact conceivable first and foremost from the point of view of economics, because of the high density of this material. If it were desired to give the piston a sufficiently low mass in order to obtain high performance of the engine, it would be necessary to arrive at a very reduced wall thickness after forging of the piston. Such a thickness is inaccessible using conventional forging techniques if, for reasons of cost, it is desired to continue producing pistons in one piece.

The object of the invention is to render possible the manufacture, under economically advantageous conditions, of pistons for high-performance internal combustion engines, particularly making it possible for this purpose to use a steel, or another dense alloy with high mechanical properties, instead of a specially treated and/or shaped aluminium alloy.

BRIEF SUMMARY OF THE INVENTION

To this end, the invention relates to a method of manufacture of a piston for an internal combustion engine in which the piston is formed from a metal part cast in one piece. Heating of a billet is carried out so as to bring it to an intermediate temperature between its solidus temperature and its liquidus temperature, and shaping thereof by thixoforging is carried out.

The invention also relates to a piston for an internal combustion engine; composed of a metal part cast in one piece, wherein it has been manufactured by heating of a billet so as to bring it to an intermediate temperature between its solidus temperature and its liquidus temperature, followed by shaping by thixoforging.

In one embodiment lugs are formed by stirrup pieces provided on the base of the internal cavity of the piston, provided with a hole for the passage of a pin joining the piston and the rod, and the piston has on its skirt openings which give access to the holes in the stirrup pieces.

The shape of the wall of the piston top can follow that of the surface of the piston top on its side intended to be turned towards the combustion chamber.

The piston can have reinforcing ribs.

The piston can be produced from carbon steel.

Its composition may then be, in percentages by weight:

$0.35\% \leqq C \leqq 1.2\%$
$0.10\% \leqq Mn \leqq 2.0\%$
$0.10\% \leqq Si \leqq 1.0\%$
traces $\leqq Cr \leqq 4.5\%$
traces $\leqq Mo \leqq 2.0\%$
traces $\leqq Ni \leqq 4.5\%$
traces $\leqq V \leqq 0.5\%$
traces $\leqq Cu \leqq 3.5\%$
traces $\leqq Al \leqq 0.060\%$
traces $\leqq Ca \leqq 0.050\%$
traces $\leqq B \leqq 100$ ppm
traces $\leqq Ti \leqq 0.050\%$
traces $\leqq Nb \leqq 0.050\%$, the other elements being iron and conventional impurities resulting from the manufacture.

It may also include up to 0.180% of S and one at least of the elements chosen from amongst up to 0.080% of Bi, up to 0.020% of Te, up to 0.040% of Se, up to 0.070% of Pb.

The piston can be produced from hot-tooling steel.

The piston can be produced from high-speed steel.

The piston can be produced from stainless steel.

The piston can be produced from cast iron.

The piston can be produced from an alloy based on Fe—Ni.

The piston can be produced from an alloy based on Ni—Co.

As will be understood, the invention is based on the use of a method of shaping known as "thixoforging", which is known per se but has never been applied to the manufacture of pistons.

Thixoforging is a process which consists of shaping a metal part by forging of a billet after having brought it to an intermediate temperature between its solidus temperature and its liquidus temperature, in such a way as to cause the solid matter and the liquid matter to coexist, intimately mixed, within the billet. By comparison with conventional hot-forging processes, this makes it possible to produce parts of complex geometry which may have thin walls, and to do this using very low shaping forces. In fact, under the action of external forces the metals undergoing a thixoforging operation behave like viscous fluids.

Thixoforging can be used for numerous sorts of alloys. The following description of the invention will concentrate on the thixoforging of carbon steels, it being understood that other alloys could be suitable for the manufacture of pistons by thixoforging.

The success of an operation of thixoforging steel depends in the first instance upon the primary structure obtained at an intermediate temperature between the solidus and the liquidus during the cycle of heating the billet before it is shaped by thixoforging. Experience shows that before the shaping operation the billet must have a globular primary structure rather than a dendritic one. In this latter case, in the course of heating the segregation of the various alloy elements between the dendrites and the inter-dendritic spaces brings about a fusion of the metal preferentially in the inter-dendritic spaces enriched with alloy elements. The resulting liquid tends to be ejected at the start of the shaping operation, which results in an increase in the forces to be applied (which are being exerted on a metal more solid than was foreseen) and the appearance of defects within the part: segregations and problems of internal condition. When the shaping operation by thixoforging is carried out on a globular primary structure by suitable heating, a homogeneous product is obtained which can deform at high speed. The dendritic primary structure of the billet can be optimized so as to obtain a homogeneous globular primary structure during heating before thixoforging. This can be obtained by acting in particular on the intensity of the electromagnetic working during the solidification of the continuously cast product which makes it possible to fragment the dendrites, and on the intensity of cooling of this product which conditions the growth of the dendrites and the diffusion of the segregating elements, all for a given product size.

If the operation is carried out on a billet produced from a rolled bar derived from a continuous casting bloom or an ingot, this makes it possible to obtain globular structure in the course of heating prior to the thixoforging, without having to carry out a separate operation of globulization of the separated primary structure. In fact, the multiple reheating and substantial deformations undergone by the steel have then led to a very imbricate and diffuse structure where a primary structure is practically impossible to show.

The heating of the billet with a view to reaching the thixoforging temperature is generally carried out by induction in order to obtain an excellent homogeneity of the temperature over all of the cross-section of the billet and an excellent reproducibility of the operation from one billet to another.

BRIEF DESCRIPTION OF THE SEVERAL VIEWS OF THE DRAWINGS

The invention will be better understood upon reading the following description which is given with reference to the accompanying drawings, in which.

DETAILED DESCRIPTION OF THE INVENTION

Figure 1:
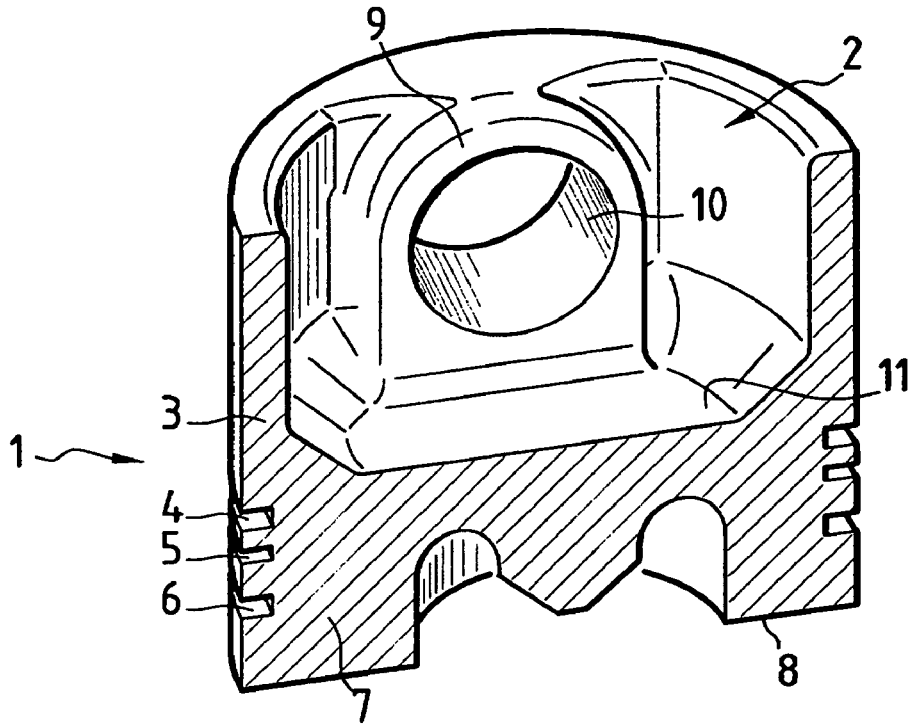
FIG.1 PRIOR ART
FIG. 1 shows in perspective and in longitudinal section an example of a piston according to the prior art, produced conventionally from forged aluminium alloy.

A piston 1 according to the prior art, which is shown in section and in perspective in FIG. 1, by way of reference, is designed to be used in a diesel engine of 1900 cc capacity with high-pressure direct injection. It is manufactured by forging of an aluminium alloy AS12UNG reinforced by alumina fibers. Its external diameter is 80 mm. In a conventional manner its different parts consist of:

- an internal cavity 2, where the rod which will drive the piston 1 can be accommodated;
- a skirt 3 constituting the lateral wall of the piston 1, intended to come into contact with the cylinder liner, particularly by means of segments (not shown) disposed in recesses 4, 5, 6 provided on the periphery of the skirt 3, at the level of a top 7 of the piston 1;
- a surface 8 of the piston top constituting the part of the piston 1 facing the combustion chamber when the piston 1 is placed in the cylinder, and of which the shape, shown solely by way of example, is conventionally designed so as to favor the combustion of the fuel;
- a lug 9 having a hole 10 with walls reinforced towards the interior of the piston 1, provided in the skirt 3 so as to permit the passage through the hole 10 of the pin intended to join the piston 1 and the rod; a similar lug is disposed symmetrically opposite the lug 9 on the half of the piston 1 which is not shown.

It may be noted that:

- the skirt 3 has a relatively great thickness, of 6 mm;
- the top of the piston 7 is also thick, with a maximum distance between its surface 8 and a base 11 of the internal cavity 2 of 29 mm,
- the distance between the top compression ring (the one which is placed in the recess 6 closest to the surface 8) and the surface 8 of the piston top 7 is 11 mm;
- the compression height, that is to say the distance between the center of the hole 10 of the lug 9 and the surface 8 of the piston top 7, is 51 mm;
- the diameter of the hole 10 of the lug 9 is 28 mm;
- the total height of the piston 1 is 68 mm;
- the weight of the piston is 525 g after machining.

Figure 2:
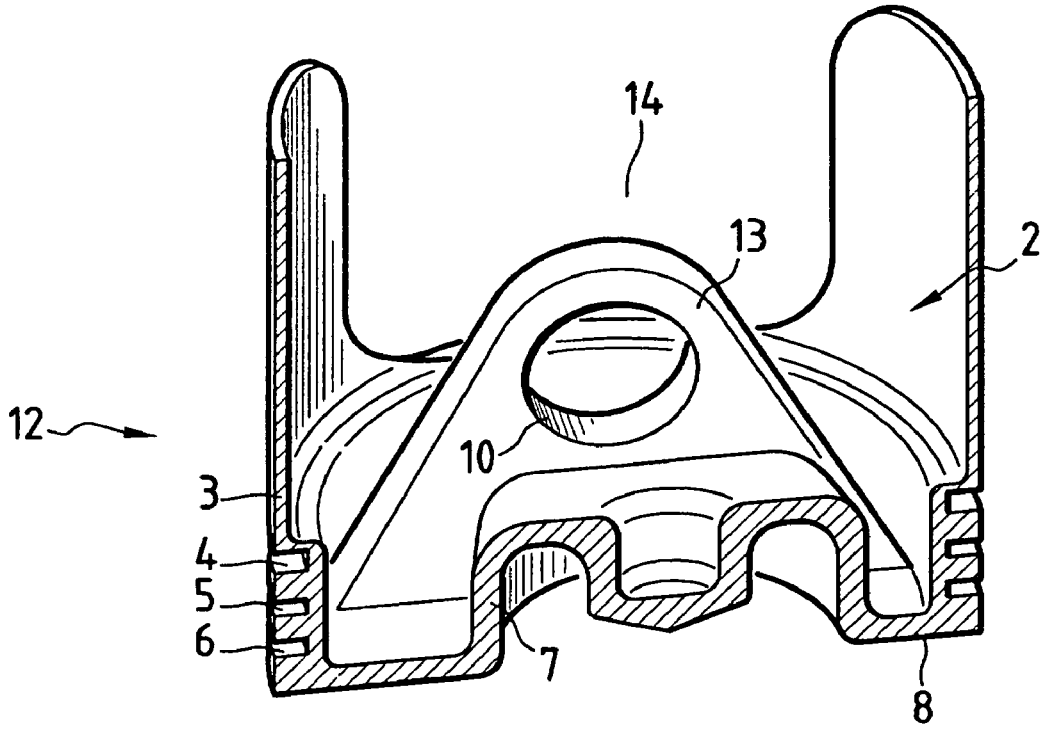
FIG. 2 shows in the same way an example of a piston according to the invention, which can be substituted for the preceding one, produced from thixoforged carbon steel.

The piston 12 according to the invention which is shown in FIG. 2 is intended to be substituted for the piston 1 according to the prior art which has just been described. It is produced by thixoforging of a carbon steel of composition (in percentages by weight): C=0.962%; Mn=0.341%; Si=0.237%; Cr=1.500%; Ni=0.089%; Mo=0.017%; Cu=0.161%; Al=0.037%; S=0.001%; P=0.009%; V=0.004%; Ti=0.002%; Sn=0.002%; N=0.0041%. The elements which are functionally equivalent to those of the piston 1 according to the prior art are designated by the same reference numerals.

It will be noted that, by comparison with the piston 1 according to the prior art:

- the skirt 3 is much thinner: its thickness is only 1.5 mm;
- the thickness of the piston top 7 is very slight, about 3 mm, and the shape of its wall follows that of its surface 8 on its side intended to be turned towards the combustion chamber; the result is that the internal cavity 2 of the piston 12 has a large volume, which gives a great economy of material, making the piston 12 considerably lighter;
- the distance between the top compression ring placed in the recess 6 and the surface 8 of the piston top 7 is 5 mm;
- the lug is no longer integrated into the skirt 3, but is constituted by a triangular stirrup piece 13 provided at the base of the cavity 2 and perforated by a hole 10; a similar stirrup piece is located symmetrically to the stirrup piece 13 in the half of the piston 12 which is not shown; in order to give access to the stirrup piece 13 and to the hole 10, the skirt 3 has a large opening 14, which also makes it possible to make the piston 12 lighter and also to reduce the contact surface between the skirt 3 and the cylinder liner and therefore the friction undergone by the piston 12 in the course of use;
- the compression height is only 32 mm;
- the diameter of the hole 10 in the stirrup piece 13 is only 20 mm, which makes it possible to reduce the diameter of the pin joining the piston 12 and the rod;
- the total height of the piston 12 is 75 mm (but it could be taken to an identical value to that of the piston 1 according to the prior art);
- the weight of the piston 12 is 500 g after machining.

This complex geometry can only be obtained on a part cast in one piece from carbon steel by the use of the thixoforging process. This alone makes possible in particular the slight thickness of the skirt 3 which has been mentioned.

It should be noted that the gain in weight obtained by this configuration applies not only to the piston itself but over the entire piston-pin and piston-rod assembly. As has been seen, the gain in weight on the piston is 25 g. The reduction from 28 to 20 mm in the diameter of the piston pin and the shortening thereof from 80 to 50 mm (the piston pin is in both cases a tube 6 mm thick) makes it possible to gain 156 g over this part. The weight of the rod can also be reduced by a few grams.

The dimensional modifications which have been indicated between the piston 1 according to the prior art made from aluminium alloy and the piston 12 according to the invention made from thixoforged steel having the aforementioned composition are rendered possible by the better mechanical and thermal characteristics of the steel demonstrated by Table 1. All the characteristics were measured at 350° C. This temperature is an average temperature which the piston in operation reaches in extreme cases, but which can be greatly exceeded locally in the vicinity of the combustion chamber of the cylinder.

TABLE 1 compared characteristics of the reinforced aluminium alloy A512UNG and the steel according to the preceding example at 450° C.

| | reinforced AS12UNG | Steel |
|---|---|---|
| Density | 2.71 | 7.83 |
| Young's modulus (MPa) | 55 000 | 190 000 |
| Poisson's ratio | 0.3 | 0.27 |
| Resistance to rupture (MPa) | 100 | 1 100 |
| Resistance to fatigue (MPa) | 50 | 400 |
| Coefficient of expansion ($10^{-6}$/K) | 20 | 12 |
| Coefficient of thermal conductivity (W/m · K) | 100 | 20 |

It will be seen that the better mechanical characteristics of the steel allow the use of a smaller quantity of material to obtain a part with equal resistance to stresses, which makes it possible to compensate for the greater density of the steel and to obtain a part which is even lighter than its equivalent made from aluminium.

Moreover, the mechanical characteristics of the steel are more stable in temperature than those of the aluminium.

Because of the lower thermal conductivity of the steel, it is possible, as has been seen, to shorten substantially the distance between the top compression ring and the base 8 of the piston. The spacing between the rings can also be reduced. All of this leads to a reduction in the quantity of material used. On the other hand, the heat released in the combustion chamber thus remains concentrated at the base of the piston. Thus the skirt undergoes less variation in temperature, which reduces the problems of expansion, as does also the lower coefficient of expansion of the steel relative to other metal alloys such as aluminium. The skirt 3 and the cylinder liner expand in almost the same way, which makes it possible to reduce the operating clearances and to evacuate the heat more rapidly towards the liner.

For the same reason, the heat from the combustion chamber is evacuated less through the steel piston than through the aluminium piston, which increases the performance of the engine.

The reduction in the compression height makes it possible to reduce the height of the cylinders and therefore improves the compactness of the engine. This is also a factor in reducing the weight of the engine.

If the piston top 7 should reach excessive temperatures, provision can be made for cooling it by a jet of oil directed into the cavity 2. This solution is in any case less complex than the use of cooling channels in the interior of the piston, which is often necessary with pistons made from aluminium.

The geometry of the piston 12 which has just been described is only an example of an embodiment of the invention, whether this be for the general appearance of the piston or for the precise dimensions of its different parts. Thixoforging also offers the possibility of providing reinforcing ribs of small thickness in different zones of the piston.

A non-limiting example of steel which can be used for manufacturing a piston by thixoforging is constituted by the following general range (in percentages by weight):

0.35%≦C≦1.2%
0.10%≦Mn≦2.0%
0.10%≦Si≦1.0%
traces≦Cr≦4.5%
traces≦Mo≦2.0%
traces≦Ni≦4.5%
traces≦V≦0.5%
traces≦Cu≦3.5%

The other elements are iron and conventional impurities resulting from the manufacture: P, Sn, N, As . . .

Optionally it is possible to add:

deoxidizing elements: Al (up to 0.060%) and/or Ca (up to 0.050%);

elements improving the hardenability, such as B (up to 100 ppm);

elements improving the machinability: S (up to 0.180%), Bi (up to (0.080%), Te (up to 0.020%), Se (up to 0.040%), Pb (up to 0.070%);

elements blocking the enlargement of the grain such as Ti (up to 0.050%) and Nb (up to 0.050%).

Two examples of such steels may be mentioned in particular:

EXAMPLE 1

C=0.377%; Mn=0.825%; Si=0.190%; Cr=0.167%; Ni=0.113%; Cu=0.143%; Al=0.022%; S=0.01%; P=0.007%; Sn=0.01%; N=75 ppm; Ca=6 ppm The measured solidus temperature of this steel is 1430° C. and the measured liquidus temperature is 1487° C. The thixoforging preferably takes place at 1480° C.

EXAMPLE 2

(the one used to produce the piston according to FIG. 2): C=0.962%; Mn=0.341%; Si=0.237%; Cr=1.500%; Ni=0.089%; Mo=0.017%; Cu=0.161%; Al=0.037%; S=0.01%; P=0.009%; V=0.004%; Ti=0.002%; Sn=0.002%; N=41 ppm The measured solidus temperature of this steel is 1315° C. and the measured liquidus temperature is 1487° C. The thixoforging preferably takes place at 1405° C.

EXAMPLE 3

C=0.825%; Mn=0.649%; Si=0.213%; Cr=0.100%; Ni=0.062%; Cu=0.107%; Al=0.035%; S=0.007%; P=0.007%; N=55 ppm The measured solidus temperature of this steel is 1360° C. and the measured liquidus temperature is 1490° C. The thixoforging preferably takes place at 1429° C.

It should be noted that the measured liquidus and solidus temperatures to which reference has just been made may differ considerably from the liquidus and solidus temperatures calculated as a function of the composition of the steel by the formulae conventionally available in the literature. In fact, these formulae are valuable in the case where the temperature of the steel lowers by several degrees per minute during solidification followed by cooling. For the determination of the optimum thixoforging temperature, the solidus and liquidus temperatures must be measured in the real conditions to which the billets will be subjected, namely reheating to ambient temperature, effected by induction at a rate of several tens of degrees per minute. However, this determination may be carried out by the person skilled in the art with the aid of conventional tests which do not present any particular difficulties.

For the materials which have just been described, the thixoforging should preferably take place with a liquid fraction representing 10 to 40% of the steel. Below 10% there is a risk that the metal does not flow correctly and solidifies too quickly on contact with the tools. Above 40% there are risks of collapse and flowing of the metal during the heating operation: the billet becomes difficult to transfer correctly to the shaping tools.

The steels of which the composition has just been explained are steels for construction or for heat treatment used in forging and mechanics. They are likely to be suitable for the manufacture of pistons for use in the majority of motor vehicles, heavy goods vehicles, agricultural machines, public works machines, ships, etc.

For applications which are particularly demanding especially in terms of the temperatures reached at the piston head, it is conceivable to use steels which permit hot working such as hot-tooling steels 38CRMoV5, 45CrMoV6, 55NICrMoV7, conventional high-speed steels or high-carbon steels, and also cast irons or alloys based on iron-nickel or cobalt-nickel. The use of stainless steels may also be envisaged for cases where the piston would be required to work in contact with fuels containing particularly corrosive additives, for example martensitic stainless steels Z40Cr13 to Z200Cr13. All these materials, as well as the carbon steels of the type which can be used in the invention, have the characteristic of a carbon content which is high (0.35% at least) or even very high. This is an element very favourable to the thixoforging operation because it lowers the solidus temperature and widens the solidification range; thus this gives easier access to the optimum range of liquid fraction in the metal.

It will be seen that the invention can be applied to a large variety of alloys, the essential feature being that their mechanical and thermal characteristics are very suitable for use in forming pistons, and that they are well adapted to thixoforging.

The invention claimed is:

1. Method of manufacture of a piston for an internal combustion engine, the said piston being formed from a steel part cast in one piece, wherein heating of a billet is carried out so as to bring it to an intermediate temperature between its solidus temperature and its liquidus temperature, and that shaping thereof by thixoforging is carried out, wherein the steel piston has a composition, in percentages by weight, of:

$0.35\% \leqq C \leqq 1.2\%$
$0.10\% \leqq Mn \leqq 2.00\%$
$0.10\% \leqq Is \leqq 1.0\%$
traces $\leqq Cr \leqq 4.5\%$
traces $\leqq Mo \leqq 2.0\%$
traces $\leqq Ni \leqq 4.5\%$
traces $\leqq V \leqq 0.5\%$
traces $\leqq Cu \leqq 3.5\%$
traces $\leqq Al \leqq 0.060\%$
traces $\leqq Ca \leqq 0.050\%$
traces $\leqq B \leqq 100$ ppm
traces $\leqq Ti \leqq 0.050\%$
traces $\leqq Nb \leqq 0.050\%$ the other elements being iron and conventional impurities resulting from the manufacture.

2. The method of claim 1, wherein the steel piston includes up to 0.180% of S and one at least of the elements chosen from amongst up to 0.080% of Bi, up to 0.020% of Te, up to 0.040% of Se, up to 0.070% of Pb.

* * * * *